US008701448B2

(12) United States Patent
Jang et al.

(10) Patent No.: US 8,701,448 B2
(45) Date of Patent: Apr. 22, 2014

(54) DRUM TYPE WASHING MACHINE

(75) Inventors: Jae Won Jang, Seoul (KR); Jin Woong Kim, Seoul (KR); Hyun Seok Seo, Seoul (KR); Min Gyu Jo, Seoul (KR)

(73) Assignee: LG Electronics Inc., Seoul (KR)

( * ) Notice: Subject to any disclaimer, the term of this patent is extended or adjusted under 35 U.S.C. 154(b) by 823 days.

(21) Appl. No.: 12/107,996

(22) Filed: Apr. 23, 2008

(65) Prior Publication Data

US 2008/0264114 A1 Oct. 30, 2008

(30) Foreign Application Priority Data

Apr. 25, 2007 (KR) ..... 10-2007-0040238

(51) Int. Cl.
*D06F 37/26* (2006.01)
*D06F 35/00* (2006.01)

(52) U.S. Cl.
USPC ..... 68/3 R; 68/24; 68/139

(58) Field of Classification Search
CPC ..... D06F 37/266; D06F 37/267
USPC ..... 68/3 R, 196, 23 R, 24, 23 A, 139, 140, 68/208
See application file for complete search history.

(56) References Cited

U.S. PATENT DOCUMENTS 2,414,154 A * 1/1947 Leef ..... 68/140
2,708,293 A * 5/1955 Sherman ..... 49/382
2,836,046 A * 5/1958 Smith ..... 68/23.2
3,089,327 A * 5/1963 Stilwell, Jr. ..... 68/139
3,159,174 A * 12/1964 Mann et al. ..... 137/374
3,321,843 A * 5/1967 Taran ..... 34/596
4,446,706 A * 5/1984 Hartwig ..... 68/24
5,107,606 A * 4/1992 Tsubaki et al. ..... 34/596
6,256,823 B1 * 7/2001 Kronbetter et al. ..... 8/158
7,251,963 B2 * 8/2007 Kim et al. ..... 68/196
7,571,626 B2 * 8/2009 Choi et al. ..... 68/196
2004/0103693 A1 * 6/2004 Kim et al. ..... 68/12.02
2004/0163426 A1 * 8/2004 Kim et al. ..... 68/23 A
2004/0187223 A1 * 9/2004 Clark ..... 8/158
2005/0178169 A1 * 8/2005 Kim et al. ..... 68/23.1
2005/0274159 A1 * 12/2005 Jeon et al. ..... 68/23.1

(Continued)

FOREIGN PATENT DOCUMENTS

DE 2 403 705 * 1/1974
DE 3738388 A1 5/1989

(Continued)

OTHER PUBLICATIONS

English language Abstract of DE 202004012221 U1.

(Continued)

*Primary Examiner* — Joseph L Perrin
(74) *Attorney, Agent, or Firm* — Ked & Associates LLP

(57) ABSTRACT

A washing machine includes a housing which forms an exterior of the washing machine and a tub mounted inside of the housing, the tub having an opening through which laundry may be inserted and removed. A drum is rotatably mounted inside of the tub, the drum having an opening substantially aligned with the opening of the tub, through which laundry may be inserted and removed. A foreign matter shield is configured to prevent foreign matter from entering a space between the tub and the drum by maintaining a gap between the opening of the drum and the tub at a predetermined size during movement of the drum relative to the tub from an initial position to a lower position.

15 Claims, 7 Drawing Sheets

(56) References Cited

U.S. PATENT DOCUMENTS

| | | | | |
|---|---|---|---|---|
| 2006/0016228 | A1 | 1/2006 | Chang et al. | |
| 2006/0169006 | A1 | 8/2006 | Lim et al. | |
| 2006/0174663 | A1 * | 8/2006 | Cimetta et al. | 68/3 R |
| 2006/0191301 | A1 | 8/2006 | Park et al. | |
| 2007/0017261 | A1 | 1/2007 | Chang et al. | |
| 2007/0039105 | A1 | 2/2007 | Lee et al. | |
| 2007/0089245 | A1 | 4/2007 | Kim et al. | |
| 2009/0178445 | A1 * | 7/2009 | Brinkmann | 68/23 A |

FOREIGN PATENT DOCUMENTS

| | | | |
|---|---|---|---|
| DE | 202004012221 U1 | | 9/2004 |
| GB | 2 296 018 | * | 6/1996 |
| JP | 03-026293 | * | 2/1991 |
| JP | 2003-164690 | * | 6/2003 |
| JP | 2006-230496 | * | 9/2006 |
| KR | 10-2004-0047196 | | 6/2004 |
| KR | 10-2006-0032746 | | 4/2006 |
| KR | 10-2006-0065939 | | 6/2006 |
| KR | 10-2007-0002360 | | 1/2007 |
| KR | 2007000194 | * | 1/2007 |
| WO | 2006/027149 A | | 3/2006 |

OTHER PUBLICATIONS

English language Abstract of DE 3738388 A1.

Korean Notice of Allowance dated Nov. 13, 2013. (translation).

* cited by examiner

DRUM TYPE WASHING MACHINE

This application claims the benefit of Korean Patent Application No. 10-2007-0040238, filed on Apr. 25, 2007, which is hereby incorporated by reference in its entirety.

BACKGROUND OF THE INVENTION

1. Field of the Invention

The present invention relates to washing machines, and more particularly, to a washing machine which can maximize a volume within a cabinet, attenuate vibration, and prevent foreign matters from entering into between a drum and a tub.

2. Discussion of the Related Art

FIG. 1 illustrates a section of a related art washing machine, and FIG. 2 illustrates a section along a line II-II in FIG. 1.

Referring to FIGS. 1 and 2, the related art drum type washing machine is provided with a cabinet or housing 1 having a base 1*a* and a door 1*b*, a tub 2 fixedly secured inside of the cabinet 1, a drum 3 rotatably mounted inside of the tub 2 for rotating laundry m and washing water by means of lifts 3*a*, a motor 4 for rotating the drum 3, and springs 5, dampers 6, and balancers 7 for attenuating vibration transmitted to the tub 2.

The drum 3 has a plurality of holes 3*b* for flow of the washing water from the tub 2 to the drum 3. The lifts 3*a* are formed on an inside surface of the drum 3, so that the lifts 3*a*, rotating together with the drum 3, move the laundry m loaded in the drum 3, together with the washing water.

The tub 2 is mounted spaced a predetermined distance away from an inside surface of the cabinet 1, suspended from an inside of the cabinet 1 with the springs 5 secured to opposite sides of an upper side of the tub 2, and dampers 6 are connected to the tub 2 and the base 1*a* with hinges and supported on the base 1*a*, so that the springs 5 and the dampers 6 attenuate the vibration from the tub 2 to the cabinet 1.

The door 1*b* on the cabinet 1 is rotatably mounted to a front 1*d* of the cabinet 1 for introduction of the laundry m thereto, and fronts 2*d* and 3*d* of the tub 2 and the drum 3 respectively have openings 2*c* and 3*c* so that the tub 2 and the drum 3 are in communication with an opening which is opened and closed by the door 1*b*.

Mounted between the front 1*d* of the cabinet 1 having the door 1 thereon and the front 2*d* of the tub 2, there is a gasket 8 for preventing the washing water from leaking, by sealing a gap between the inside of the cabinet 1 and the front 2*d* of the tub 2.

The motor 4, on a rear surface of the tub 2, rotates the drum 3 in the tub 2.

The balancer 7 is mounted to, and balances the drum 3. The balancer 7 of a predetermined weight provides centrifugal force to the drum 3 rotating at a high speed in spinning, to attenuate vibration of the drum 3.

The related art drum type washing machine has a problem in that a volume of the cabinet or housing 1 is excessively large in comparison to the volume of the drum 3 in which washing is performed.

That is, because the front and sides of the tub 2 are spaced predetermined distances (a in FIG. 1, and b in FIG. 2) away from the cabinet 1 respectively, the volume of the drum 3 is reduced when the sizes of the cabinets 1 are the same.

SUMMARY OF THE INVENTION

Accordingly, the present invention is directed to a washing machine.

An object of the present invention is to provide a washing machine which can maximize a volume of a drum for cabinets of the same size.

Another object of the present invention is to provide a washing machine in which infiltration of foreign matters between a tub and a drum can be prevented.

Additional advantages, objects, and features of the invention will be set forth in part in the description which follows and in part will become apparent to those having ordinary skill in the art upon examination of the following or may be learned from practice of the invention.

According to a first aspect of the present invention, a washing machine includes a housing which forms an exterior of the washing machine; a tub mounted inside of the housing, the tub having an opening through which laundry may be inserted and removed; a drum rotatably mounted inside of the tub, the drum having an opening substantially aligned with the opening of the tub, through which laundry may be inserted and removed; and a foreign matter shield configured to prevent foreign matter from entering a space between the tub and the drum by maintaining a gap between the opening of the drum and the tub at a predetermined size during movement of the drum relative to the tub from an initial position to a lower position.

The drum may be moved downwardly relative to the tub by the weight of laundry in the drum.

The foreign matter shield may include a catch-space configured to hold foreign matter to prevent foreign matter introduced through the gap between the opening of the drum and the tub from entering into a space between an outer circumferential surface of the drum and an inner circumferential surface of the tub. The catch-space of the foreign matter shield may have a drain hole for draining washing water from the catch-space.

The foreign matter shield may be configured to cover an area which the opening of the drum traverses during upward and downward movement of the drum. A predetermined distance may be maintained between the foreign matter shield and the opening of the drum during upward and downward movement of the drum.

The foreign matter shield may be formed of an elastic material. The washing machine may further include a drum guide extending from the opening of the drum toward the foreign matter shield.

According to another aspect of the present invention, a washing machine includes a housing which forms an exterior of the washing machine; a tub mounted inside of the housing, the tub having an opening through which laundry may be inserted and removed; a drum rotatably mounted inside of the tub, the drum having an opening substantially aligned with the opening of the tub, through which laundry may be inserted and removed; a first rib extending from an inner circumferential surface of the opening of the tub toward the opening of the drum; and a second rib extending a predetermined distance from the first rib toward an outer circumferential surface of the tub for maintaining a gap between the opening of the drum and the tub at a predetermined size during movement of the drum relative to the tub from an initial position to a lower position.

The drum may be moved downwardly relative to the tub by the weight of laundry in the drum.

The first rib may be formed along the inner circumferential surface of the opening of the tub. The second rib may be formed at least partially within an extent of the first rib.

The second rib may include a side which faces the drum and is configured to cover an area which the opening of the drum traverses during upward and downward movement of the drum. A predetermined distance may be maintained between the side of the second rib which faces the drum and the opening of the drum during upward and downward movement of the drum.

The second rib may include at least a portion which contacts and is supported by the tub.

The second rib may include a catch-space configured to hold foreign matter introduced between the first rib and the opening of the drum. The catch-space of the second rib may have a drain hole for draining washing water from the catch-space.

The second rib may include a friction reduction coating that reduces friction during contact between the second rib and the drum.

The second rib may be formed of an elastic material. The washing machine may further include a drum guide extending from the opening of the drum toward the first rib.

It is to be understood that both the foregoing general description and the following detailed description of the present invention are exemplary and explanatory and are intended to provide further explanation of the invention.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
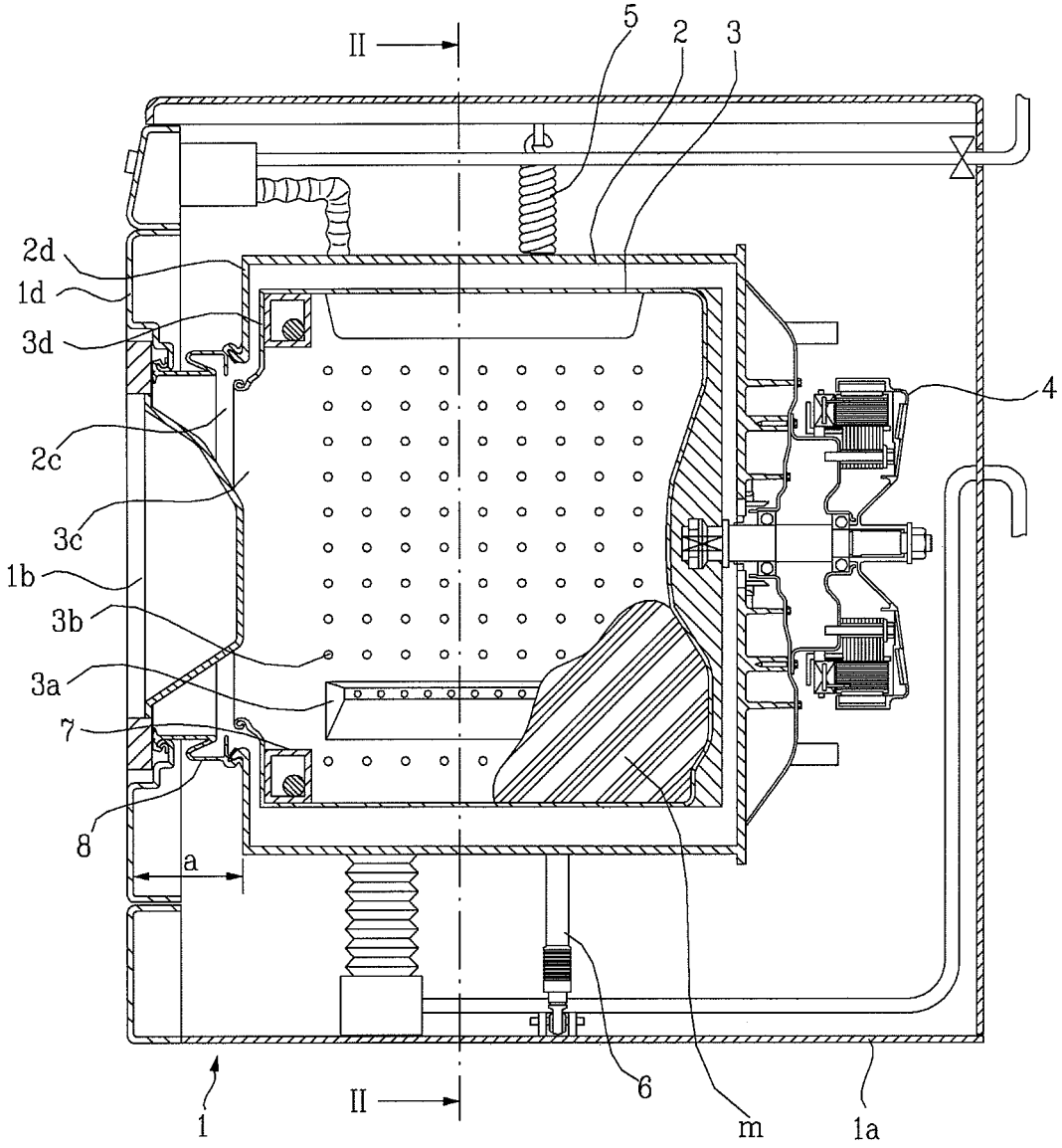
FIG. 1 is a sectional view illustrating a related art washing machine, schematically.
Figure 2:
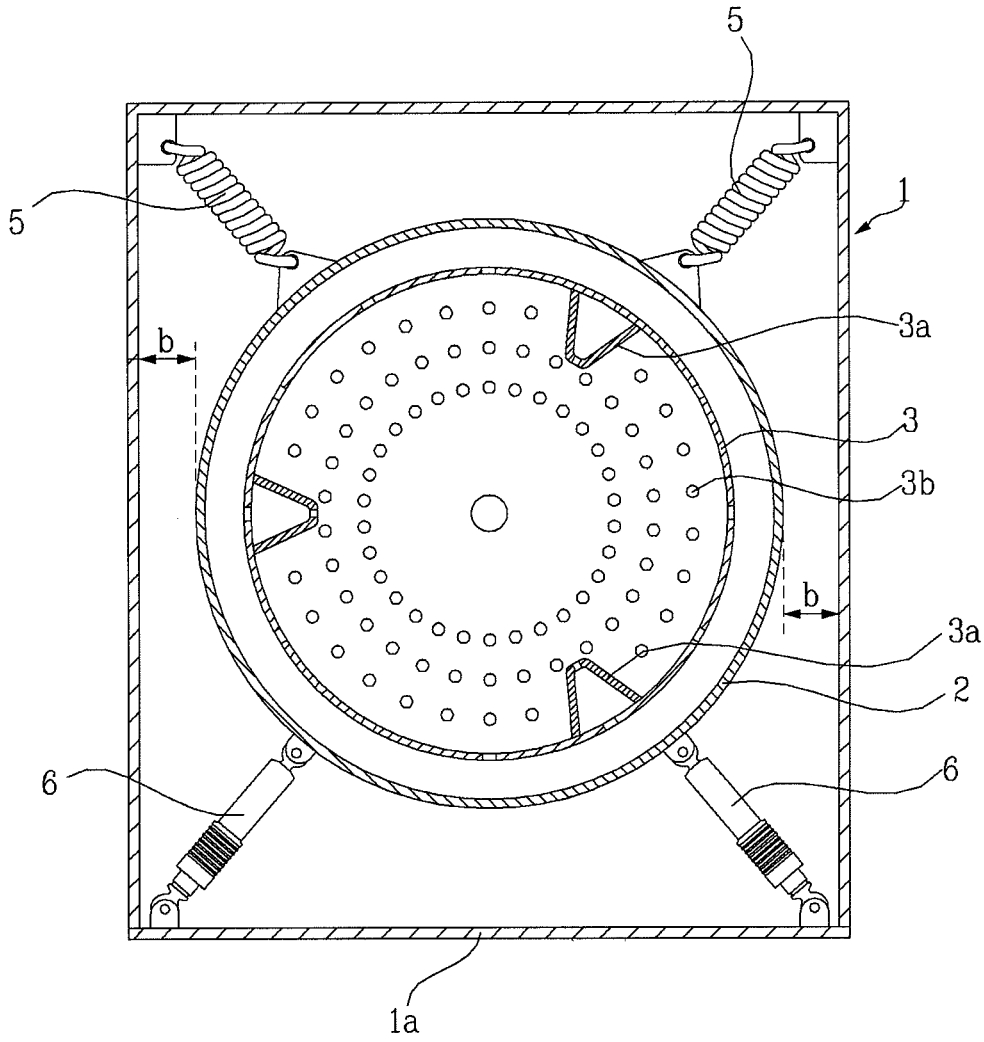
FIG. 2 is a sectional view illustrating a section across a line II-II in FIG. 2.
Figure 3:
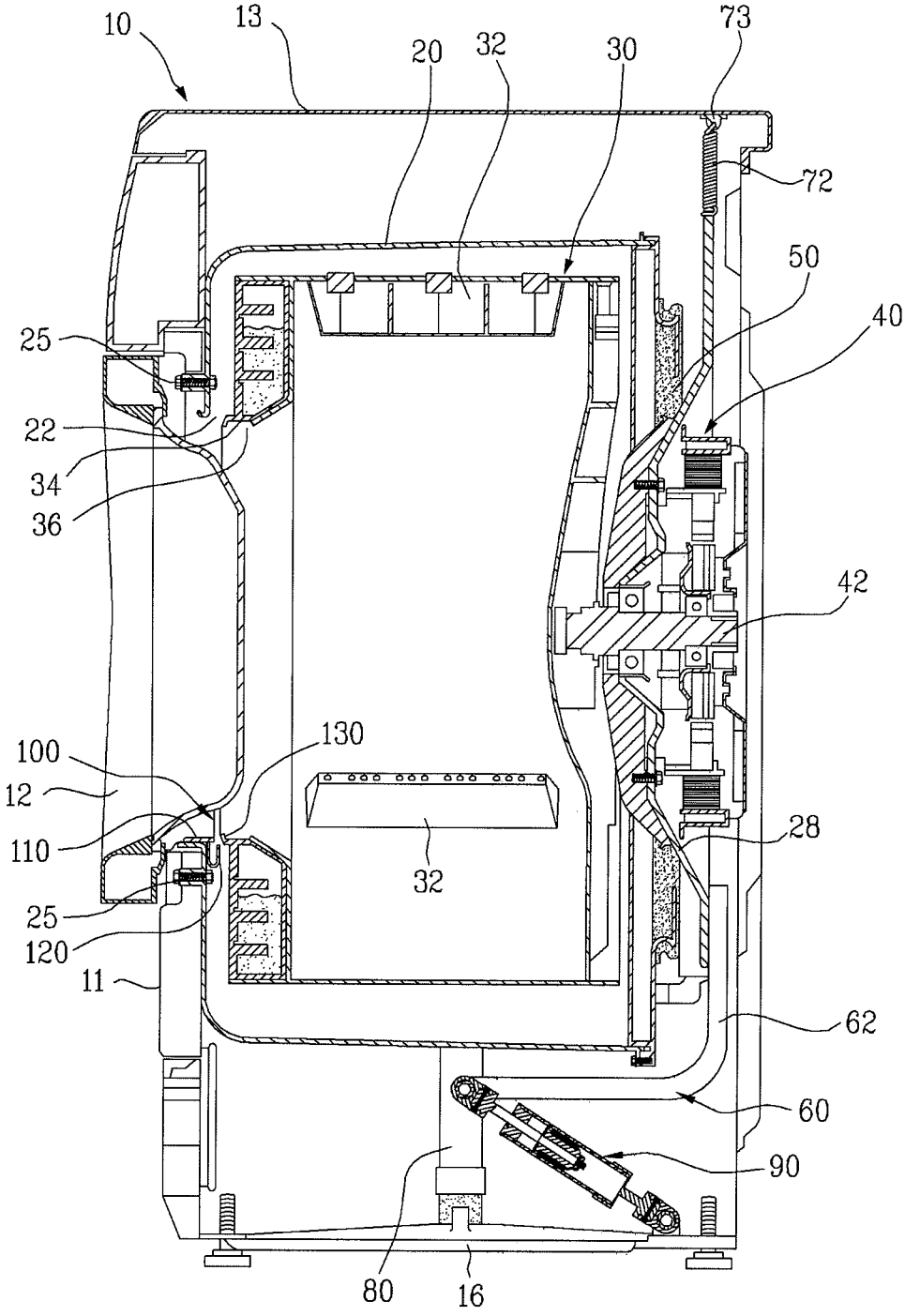
FIG. 3 is a sectional view illustrating a washing machine in accordance with a first embodiment of the present invention.
Figure 4:
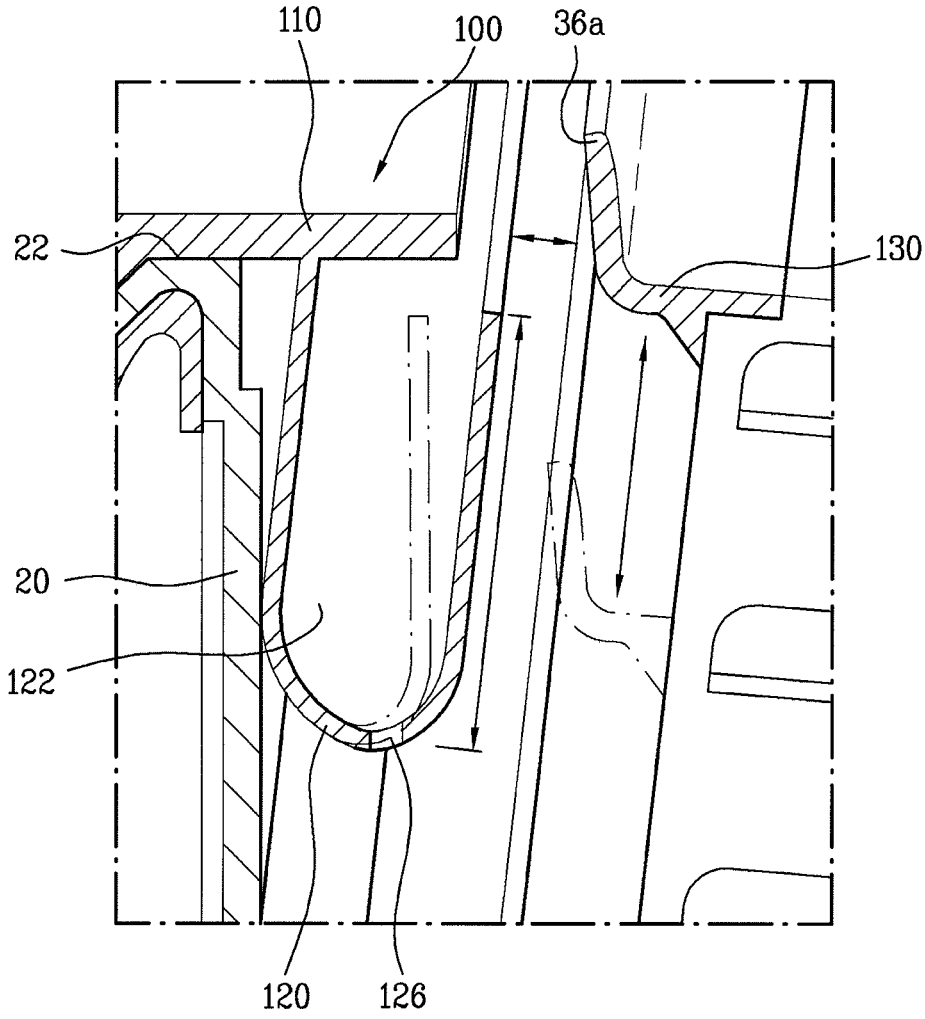
FIG. 4 is an enlarged sectional view illustrating a portion of FIG. 3.

FIGS. 3 and 4 illustrate diagrams of drum type washing machines in accordance with preferred embodiments of the present invention, respectively.

Referring to FIG. 3, the drum type washing machine of the present invention includes a cabinet or housing 10 which forms an exterior of the drum type washing machine, a tub 20 fixedly secured to an inside of the cabinet 10 directly, a drum 30 rotatably mounted to an inside of the tub 20, a motor 40 in rear of the tub 20 for rotating the drum 30, a bearing housing 28 forming a rear of the tub 20 and supporting a shaft 42 of the motor 40, damping device or element 50 between the bearing housing 28 and the tub 20 for sealing the inside of the tub 20 and damping vibration or impact from the motor 40 to the tub 20, and a suspension assembly 60 for supporting the drum 30 and attenuating the vibration or impact to the bearing housing 28.

The cabinet or housing 10 has a laundry opening in a front 11 for introduction of laundry, with a door 12 mounted thereto for opening/closing the laundry opening. There is a base 16 of the cabinet 10, which forms a bottom surface of the cabinet 10.

The tub 20 is fixedly secured to the inside of the cabinet 10 directly. A side of the tub 20 facing the door 12 may be fixedly secured to an inside of the front 11 of the cabinet 10 in any suitable manner, such as fastened with screws 25. Of course, sides or a rear of the tub 20 may be fixedly secured to the cabinet 10. The tub 20 has a laundry opening 22 in a front adjacent to the door for introduction of the laundry.

There may be a top bracket 73 on an upper side of the cabinet 10 for securing an elastic member 72 thereto, which suspends the bearing housing.

The bearing housing 28 is fixedly secured to the rear of the tub 20. The bearing housing 28 is provided with bearings (not shown) for supporting, and smooth rotation of, the motor shaft 42.

It is preferable that the damping device 50 is formed of an elastic material that contracts, or relaxes according to the vibration or the impact, for damping transmission of vibration or impact from the drum 30 and the motor 40 to the tub 20 during washing or spinning.

The motor 40 is fixedly secured to a rear side of the bearing housing 28, with a motor shaft 42 passed through the bearing housing 28 and fixed to a rear side of the drum 30.

The drum 30 is rotated by the motor shaft 42 and has lifts 32 on an inside surface for moving the laundry during rotation of the drum 30. On a front side of the drum, there is a liquid balancer 34 for suppressing vibration of the drum during spinning.

The suspension assembly 60 includes a damper bracket 62 fixed to the bearing housing 28, and a damping unit coupled to the damper bracket 62 for supporting the bearing housing 28.

The damping unit may include a main damper 80 for supporting weight of the drum 30 and damping vertical direction vibration of the drum 30, and a sub-damper 90 for damping horizontal direction vibration of the drum 30.

In this manner, the drum 30 and the bearing housing 28 are suspended in the tub 20 by the damping unit of the main damper 80 and the sub-damper 90.

Since the tub 20 is fixedly secured to the cabinet 10 directly so as not to move with respect to the cabinet 10, the washing machine of the embodiment can enlarge a diameter of the tub 20, allowing volumes of the tub 20 and the drum 30 to be enlarged.

Moreover, since the drum 30 is supported only on one side, the volume of the drum 30 can be enlarged further compared to a type in which the drum 30 is supported on both sides. Since a number of components can be reduced as in this manner, improvement in productivity can be achieved.

Moreover, since the tub 20 is fixedly secured to the cabinet 10, if vibration or impact is applied to the tub 20 which is fixedly secured to the cabinet 10 as one unit, the tub 20 by itself is not shaken by the vibration or impact, but because a weight of the cabinet 10 is added to a weight of the tub 20, and increases stiffness or rigidity of the tub 20, an overall vibration characteristic of the drum type washing machine can be improved.

A predetermined gap is provided between the tub 20 and the drum 30 so that the drum 30 does not come into contact with the tub 20 when the drum 30 vibrates. However, in the event that foreign matter, such as coins or buttons, are located between the tub 20 and the drum 30, the foreign matter are likely to hit the drum 30 to cause noise, and further, when the drum 30 spins at a high speed, the tub 20 or the drum 30 can be damaged.

In order to prevent this from occurring, it is necessary to provide a structure for preventing the foreign matter from entering between the tub 20 and the drum 30. Moreover, as the drum 30 is supported on the damping unit of the main dampers 80 and the sub-dampers 90, when the laundry is introduced into the drum 30, the drum 30 is likely to move down by the weight of the drum 30. If the drum 30 moves down in this manner, the gap between the tub 20 and an opening 36 of the drum 30 can become greater, increasing the possibility of the foreign matter entering between the gap.

Therefore, the washing machine in accordance with a preferred embodiment of the present invention includes a foreign matter entering preventive device or shield 100 for preventing foreign matter from entering between the tub 20 and the drum 30 by making the gap between the opening 36 of the drum 30 and the tub to be maintained even if the drum 30 moves down by the weight of the laundry.

Referring to FIGS. 3 and 4, the foreign matter entering preventive device or shield 100 may include a first rib 110 provided at the opening of the tub 20, and a second rib 120 extended from the first rib 110 toward an outside circumference of the tub 20.

FIG. 4 is an enlarged sectional view illustrating the foreign matter entering preventive device 100.

The first rib 110 may be formed along an inside circumference of the laundry opening 22 of the tub 20, extended toward an inside of the tub 20 by a predetermined length.

It is preferable that the second rib 120 is extended from the first rib 110 toward an outside circumference of the tub 20 by a predetermined length to form a free end.

It is preferable that the gap between the second rib 120 and the opening 36 of the drum, more specifically, between the second rib 120 and an edge 36*a* of the opening 36 of the drum facing the door is small enough to prevent the foreign matters from entering.

That is, when the drum 30 has not moved down, the first rib 110 maintains the gap between the edge 36*a* of the opening of the drum and the first rib 110, to prevent the foreign matters from entering therebetween. The second rib 120 maintains the gap between the edge 36*a* of the opening of the drum and the second rib 120 even when the drum 30 moves down by the weight of the laundry, to prevent the foreign matter from entering therebetween. This will be described in more detail hereafter.

The foreign matter may be a hard substance, such as coins and buttons in the laundry, which, if located between the tub 20 and the drum 30, are likely to cause noise or damage during washing.

The gap between the foreign matter entering preventive device or shield 100 and the edge 36*a* of the opening of the drum is provided for preventing the foreign matter entering preventive device or shield 100 from being brought into contact with the drum 30 when the drum 30 rotates.

Although there is a gap between the foreign matter entering preventive device 100 and the drum 30, the drum 30 and the second rib 120 may come into contact or collide with each other due to vibration of the drum 30 during operation of the washing machine. Accordingly, it is preferable that the second rib 120 or the foreign matter entering preventive device or shield 100 is formed of an elastic material which enables deformation and restoration, for preventing the second rib 120 or the foreign matter entering preventive device or shield 100 from being damaged by the impact caused by collision with the drum 30.

A suitable friction preventive coating may be applied to a surface of the second rib 120 facing the edge 36*a* of the opening of the drum for minimizing friction when the second rib 120 is in contact with the drum. Of course, the second rib 120 or the foreign matter entering preventive device 100 itself may be formed of a material having a low friction coefficient.

If the second rib 120 deforms excessively at the time the drum 30 is brought into contact, or collides, with the second rib 120, since the excessive deformation is liable to break the second rib 120 or affect the first rib 110, it is preferable that the second rib 120 is formed such that a portion thereof can be supported by an inside surface of the tub 20 when the second rib 120 comes into contact with the tub 20 for preventing the second rib 120 from deforming excessively.

Moreover, due to weight of the laundry, the drum 30 is likely to move downward. Therefore it is necessary to maintain the gap between the second rib 120 and the opening 36 of the drum. Accordingly, it is preferable that the second rib 120 is formed in conformity with a locus the edge 36*a* of the opening of the drum forms at the time the drum 30 moves down, with a predetermined gap to the locus. In this manner, the second rib 120 covers an area which the opening of the drum traverses during upward and downward movement of the drum. Of course, it is preferable that the gap is small enough to prevent the foreign matter from falling down therebetween.

It is preferable that the second rib 120 has a length at least as long as a moving up/down distance of the drum 30. If the second rib 120 has a length shorter than the moving up/down distance of the drum 30, a distance between the second rib 120 and the edge 36*a* of the opening of the drum will become greater when the drum 30 moves beyond the second rib 120, permitting the foreign matter to enter therebetween.

The second rib 120 may be formed at least on a portion of the outside circumference of the first rib 110.

That is, the second rib 120 may be formed throughout the outside circumference of the first rib 110, or only on a portion of the outside circumference of the first rib 110.

Figure 5:
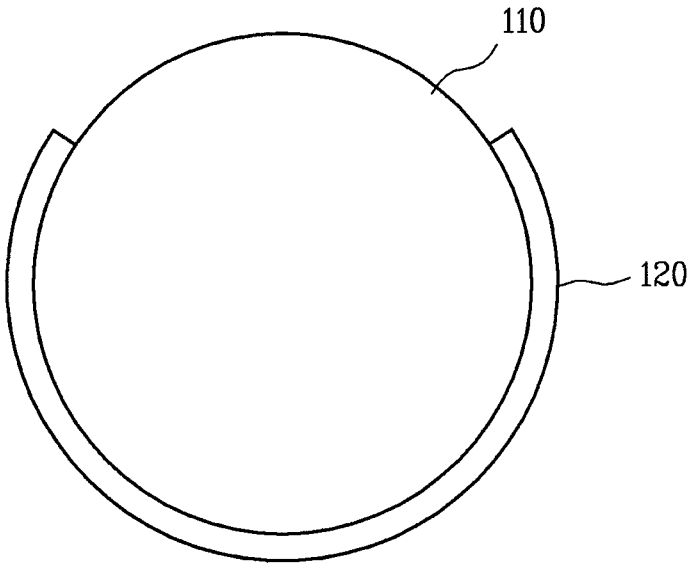
FIG. 5 is a front view illustrating the foreign matter entering preventive device in FIG. 3.

Referring to FIG. 5, when the second rib 120 is formed only on a portion of the first rib 110, it is preferable that the second rib 120 is formed at a portion excluding an upper portion of the first rib 110.

Although the first rib 110 extends toward the drum 30, foreign matter with sizes smaller than the gap between the first rib 110 and the edge 36*a* of the opening of the drum may fall between the first rib 110 and the edge 36*a* of the opening of the drum.

Therefore, the second rib 120 may have a U-bent portion to form a holding space or catch-space 122 for holding the foreign matter.

The holding space or catch-space 122 has a side facing the drum 30 having the predetermined gap to the locus the edge 36*a* of the opening of the drum forms when the drum 30 moves down.

Of course, as described before, a friction preventive coating may be applied to the side of the holding space 122 facing the drum 30, a portion of the holding space 122 may be in contact with the inside surface of the tub 20 for preventing the second rib 120 from deforming excessively, and reducing impact caused when the drum 30 comes into contact with the second rib 120 transmitted to the first rib 110.

Moreover, it is preferable that the drum 30 and the second rib 120 are configured so that the impact caused by the contact of the drum 30 can be absorbed by deformation of the bent portion of the holding space 122 of the second rib 120 and the side of the drum 30 facing the opening 36.

The holding space 122 formed on at least a portion of the second rib 120 captures the foreign matter shooting out of the drum 30 in a circumferential direction of the drum 30 by rotation force of the drum 30 during the drum 30 rotation, thereby preventing the foreign matter from entering between the tub 20 and the drum 30.

It is preferable that a drain hole 126 is formed in a bottom of the holding space for draining washing water introduced therein into the tub 20.

A drum guide 130 may further be provided, which is extended from the opening 36 of the drum 30 toward an inside circumference of the laundry opening 22 of the tub 20 for preventing the laundry being introduced into the drum 30 from being inserted between the tub 20 and the drum 30, and the drum 30 from being brought into direct contact with the tub 20.

If the drum guide 130 is provided, the edge 36*a* of the drum opening is an edge of the drum guide 130.

The operation of the washing machine of the present invention will be described.

A preparation step is made before the user puts the washing machine into operation, in which the laundry is introduced to the drum 30 of the washing machine, and provides detergent.

Since the drum 30 is at an initial position before the user introduces the laundry to the drum 30, the gap between the edge 36*a* of the opening of the drum and the tub 20 is maintained by the first rib 110 of the foreign matter entering preventive device 100, thereby preventing the foreign matter from passing through the gap.

As the laundry is introduced to the drum 30, the drum 30 is moved down gradually by the weight of the laundry. Since the second rib 120 is formed in conformity with the locus the edge 36*a* of the opening of the drum forms when the drum 30 moves down, maintaining the gap between the tub 20 and the opening 36 of the drum small enough to prevent the foreign matter from falling down therebetween, foreign matter is prevented from falling down between the tub 20 and the drum 30.

The washing is performed as the drum 30 rotates following the washing machine being put into operation. When the washing is performed, the laundry is elevated, and falls down within the drum 30 following rotation of the drum 30. During this period, since the foreign matter entering preventive device 100 maintains the gap between the tub 20 and the edge 36*a* of the drum opening, the introduction of the foreign matter between the tub 20 and the drum 30 is prevented.

Since the tub 20 rotates at a high speed during the spinning cycle, the drum 30 moved down by the weight of the laundry rises again to the initial position by centrifugal force of the drum 30. During this period, since the gap between the tub 20 and the edge 36*a* of the drum opening is maintained by the first rib 110, the introduction of the foreign matter, shooting out by centrifugal force, between the tub 20 and the drum 30 is prevented.

If the spinning cycle is finished, the drum 30 can move down more or less by the weight of the laundry, when, as described before, since the gap between the tub 20 and the edge 36*a* of the drum opening is maintained by the second rib 120, the introduction of the foreign matter between the tub 20 and the drum 30 is prevented.

Although small foreign matter can be introduced between the first rib 110 and the opening of the drum 36 during the cycles described above, since such foreign matter are caught in the holding space 122, the introduction of the foreign matter between the tub 20 and the drum 30 is prevented.

Although the second rib 120 of the foreign matter entering preventive device 100 is bent to form the holding space 122 in the first embodiment, the second rib may not be provided with the holding space in another embodiment of the present invention.

Other embodiments of the present invention will be described. Parts identical to the foregoing embodiments will be given the same names and reference numerals, and description of which will be omitted.

Figure 6:
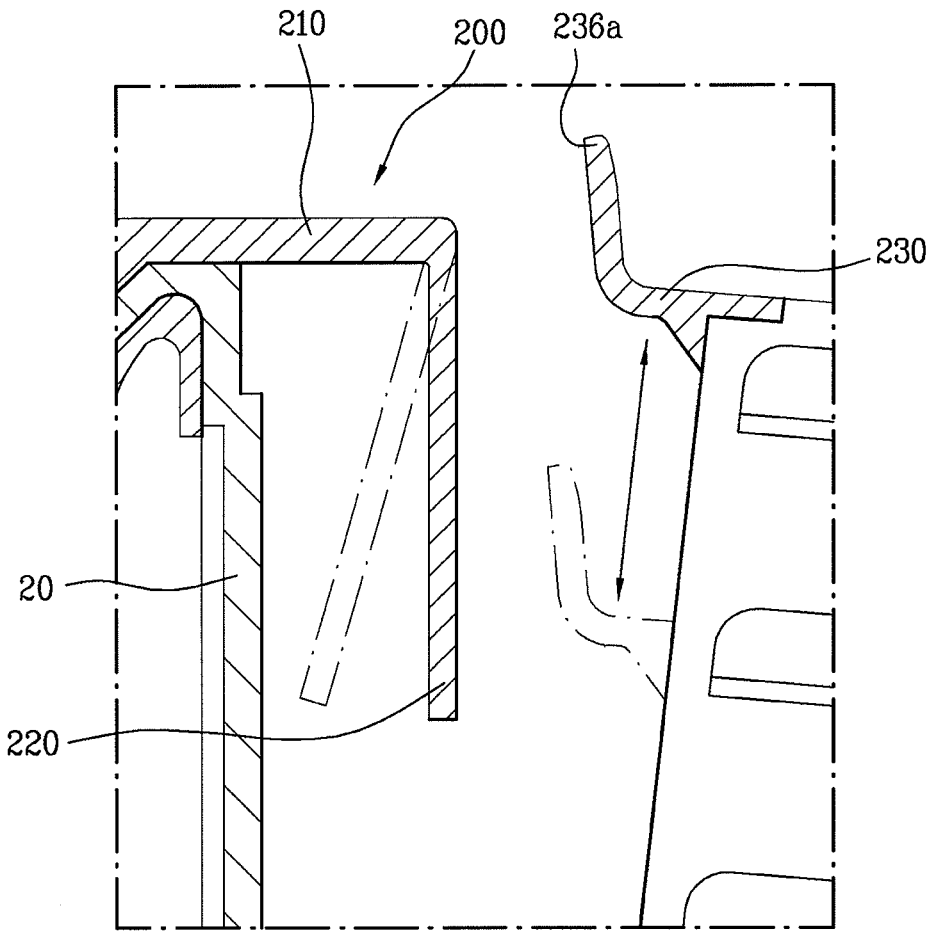
FIG. 6 is a sectional view illustrating a foreign matter entering preventive device in accordance with a second embodiment of the present invention.

FIG. 6 is a sectional view illustrating a foreign matter entering preventive device or shield 200 in accordance with a second preferred embodiment of the present invention.

In the embodiment, the second rib 220 of the foreign matter entering preventive device 200 can be extended from the first rib 210 in a horizontal direction.

In the embodiment, if the drum comes into contact with the second rib 220, the second rib 220 deforms elastically to absorb the impact. If the second rib 220 deforms more than a certain extent, the edge of the second rib 220 comes into contact with the inside surface of the tub 20, preventing the second rib 220 from deforming excessively.

Reference numeral 230 denotes a drum guide which is the same as in the first embodiment.

Figure 7:
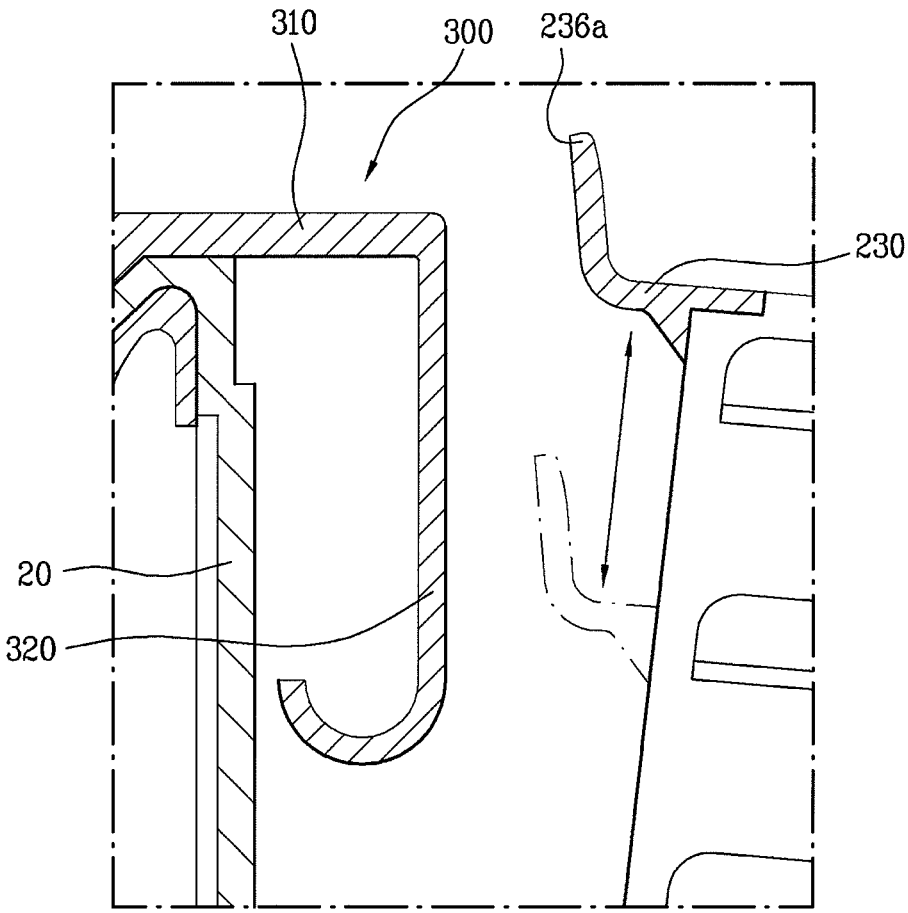
FIG. 7 is a sectional view illustrating a foreign matter entering preventive device in accordance with a third embodiment of the present invention.

FIG. 7 is a sectional view illustrating a foreign matter entering preventive device or shield 300 in accordance with a third preferred embodiment of the present invention.

A second rib 320 of the foreign matter entering preventive device 300 of the embodiment is extended from a first rib 310 toward an outside circumference of the tub 20, with an edge curved toward a front of the tub 20.

In this manner, if the second rib 320 deforms more than a certain extent, a curved portion comes into contact with the inside surface of the tub 20 elastically, thereby supporting the second rib 320.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

As has been described, the drum type washing machine of the present invention has the following advantages.

First, since the tub is fixedly secured to the cabinet directly, a diameter of the tub can be enlarged, permitting enlargement of a volume of the tub and the drum.

Second, the one side supporting of the rotating drum permits enlargement of the volume of the drum further in comparison to two side supporting of the drum, and improvement of productivity since a number of components are reduced as the supporting points are reduced.

Third, since the tub is fixedly secured to the cabinet, in a case that vibration or impact is transmitted to the tub, not only the tub itself shakes by the vibration or impact, but also the cabinet shakes together with the tub, to improve an overall vibration characteristic of the drum type washing machine, since weight of the cabinet is added to weight of the tub, resulting in increased stiffness or rigidness of the tub.

Fourth, the foreign matter entering preventive device, maintaining a gap between an opening of the drum and the tub not only when the drum is at an initial stage, but also when the drum moves down by weight of laundry, prevents foreign matter from entering between the drum and the tub, thereby preventing noise and the tub and the drum suffering from damage, to improve reliability.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A washing machine, comprising:

a tub mounted inside of a housing, the tub having an opening through which laundry is inserted and removed;

a drum rotatably mounted inside of the tub and having an opening through which the laundry is loaded and unloaded, an edge of the opening of the drum being spaced away from an inner surface of the tub by a gap extending in an axial direction of the drum;

a drive assembly including a shaft that connects to the drum, a bearing housing that rotatably supports the shaft, and a motor fixed to a rear side of the bearing housing and directly connected to the shaft to rotate the shaft;

a foreign matter shield attached to the tub, the foreign matter shield including a first rib that extends in the axial direction of the drum to partially cover the gap between the tub and the edge of the opening of the drum and prevent foreign matter larger than a gap between the drum and the first rib from entering a space between the tub and the edge of the opening of the drum, and a second rib that extends from an outer circumferential surface of the first rib in a radial direction of the tub in an inner space of the tub;

a suspension assembly attached to the bearing housing that flexibly supports and reduces vibrations of the drum and the drive assembly; and an elastic material connected between the tub and the bearing housing that prevents water inside the tub from leaking toward the drive assembly and allows the drive assembly to move relative to the tub.

2. The washing machine as claimed in claim 1, wherein the first rib is radially enlarged to cover the gap which changes in correspondence with a vertical movement of the edge of the opening of the drum.

3. The washing machine as claimed in claim 1, wherein the second rib comprises a radially extended surface.

4. The washing machine as claimed in claim 1, wherein the second rib comprises a catch-space configured to hold the foreign matter introduced through the gap.

5. The washing machine as claimed in claim 4, wherein the catch-space of the second rib includes a drain hole that drains washing water from the catch-space.

6. The washing machine as claimed in claim 1, wherein the second rib comprises:

a supporting portion that radially extends from the first rib and sits on a radially enlarged surface of the tub; and a horizontal portion that extends from the supporting portion toward the edge of the opening of the drum to cover the gap.

7. The washing machine as claimed in claim 6, wherein an end of the horizontal portion is inwardly bent in a radial direction.

8. The washing machine as claimed in claim 1, wherein the first rib is configured to be attached to an inside circumferential surface of the opening of the tub.

9. The washing machine as claimed in claim 8, wherein the first rib is fixed to the opening of the tub.

10. The washing machine as claimed in claim 1, wherein the second rib includes a friction reduction coating that reduces friction during contact between the second rib and drum.

11. The washing machine as claimed in claim 1, further comprising a drum guide that extends from the opening of the drum toward the first rib.

12. The washing machine as claimed in claim 1, wherein the second rib extends radially from an inner end of the first rib.

13. The washing machine as claimed in claim 12, wherein the second rib includes a portion at an inner end thereof that extends in the axial direction of the drum.

14. The washing machine as claimed in claim 13, wherein the portion at an inner end thereof that extends in the axial direction of the drum is curved.

15. The washing machine as claimed in claim 1, wherein the tub is fixedly supported.

* * * * *